US010273701B2

(12) United States Patent
Khamis et al.

(10) Patent No.: US 10,273,701 B2
(45) Date of Patent: Apr. 30, 2019

(54) FIBERGLASS POOL BODY WITH BUILT-IN STRESS RISER

(71) Applicant: Thursday Pools, Fortville, IN (US)

(72) Inventors: William Khamis, Fortville, IN (US); Edward Vondell, Fishers, IN (US)

(73) Assignee: Thursday Pools, Fortville, IN (US)

( * ) Notice: Subject to any disclaimer, the term of this patent is extended or adjusted under 35 U.S.C. 154(b) by 0 days.

(21) Appl. No.: 15/866,801

(22) Filed: Jan. 10, 2018

(65) Prior Publication Data

US 2018/0258662 A1 Sep. 13, 2018

Related U.S. Application Data

(60) Provisional application No. 62/469,198, filed on Mar. 9, 2017.

(51) Int. Cl.

| | |
|---|---|
| ***E04H 4/00*** | (2006.01) |
| ***E04H 4/06*** | (2006.01) |
| ***E04H 4/14*** | (2006.01) |

(52) U.S. Cl.

CPC ..... *E04H 4/0037* (2013.01); *E04H 4/06* (2013.01); *E04H 2004/146* (2013.01)

(58) Field of Classification Search

CPC ..... E02D 17/202; E04H 4/0037; E04H 4/00

USPC ..... 4/506

See application file for complete search history.

(56) References Cited

U.S. PATENT DOCUMENTS

| | | | | |
|---|---|---|---|---|
| 9,593,455 | B2 * | 3/2017 | Khamis | E04H 4/0037 |
| 9,769,045 | B2 * | 9/2017 | Khamis | E04H 4/0037 |

* cited by examiner

*Primary Examiner* — Lori L Baker

(74) *Attorney, Agent, or Firm* — C. John Brannon; Brannon Sowers & Cracraft PC

(57) ABSTRACT

A swimming pool assembly, including a preformed swimming pool body defining bottom floor member and at least one sidewall member connected thereto and extending therefrom, and a groundwater protection device positioned in the bottom floor member. The groundwater protection device defines a predetermined failure mode under applied external hydrostatic forces generated by groundwater to yield an aperture through the bottom floor member through which groundwater may flow into the fiberglass swimming pool body.

2 Claims, 7 Drawing Sheets

FIBERGLASS POOL BODY WITH BUILT-IN STRESS RISER

CROSS-REFERENCE TO RELATED APPLICATIONS

This patent application is a non-provisional of, and claims priority to, U.S. Provisional Patent Application Ser. No. 62/469,198, filed on Mar. 9, 2017.

TECHNICAL FIELD

The present novel technology relates generally to the field of excavation, and, more particularly, to the stabilization of in-ground fiberglass pool bodies, such as with pressure release features to equalize and/or relieve external hydrostatic forces.

BACKGROUND

Preformed fiberglass swimming pools offer many advantages over in-situ formed shotcrete or concrete walled swimming pools. Fiberglass pool bodies may be quickly and inexpensively formed and require considerably less effort to put into the ground. The main drawback associated with fiberglass swimming pools has been the tendency for the bottom and/or sides to bulge inward from geological and/or hydrostatic forces from accumulated groundwater if the backfill around the pool is not properly done and/or if the pool body is underfilled or drained beyond a minimum threshold amount of remaining water left in the pool body. The backfill around the pool perimeter is typically sand, gravel, or a combination of the two. In the case of sand, a poor backfilling job may result in settling of the sand, which may lead to an inward bulging of the pool floor and/or sidewalls. Gravel backfill is less prone to flowing and settling, but is harder to evenly distribute around the outer surface of a pool, especially if that surface is irregularly shaped. Further, some pool owners insist upon emptying the pool of water, such as for thorough cleaning, and as fiberglass pool designs rely on contained water to provide positive pressure to resist inward bulging of the sides and/or hydrostatic forces pushing against the pool bottom, such imbalanced forces may urge the pool upwardly, resulting in a ruptured pool bottom and/or dislodgement of the pool body.

Ground water may cause major damage and expensive repair costs to in-ground pools, if not managed properly. Swimming pool owners have concrete pools popping out of the ground, vinyl liners floating, and fiberglass pools being warped, cracked and dislodged due to the application of uncontrolled hydrostatic forces.

Thus, there remains a need for a method and apparatus that would allow for the release of inwardly and/or upwardly directed forces acting against the emplaced fiberglass pool body so as to resist inward bulging of the pool bottom and/or sidewalls over time, as well as reduce or eliminate upwardly directed forces urging the pool body out of the ground. The present novel technology addresses this need.

DETAILED DESCRIPTION OF THE PREFERRED EMBODIMENT

Figure 1:
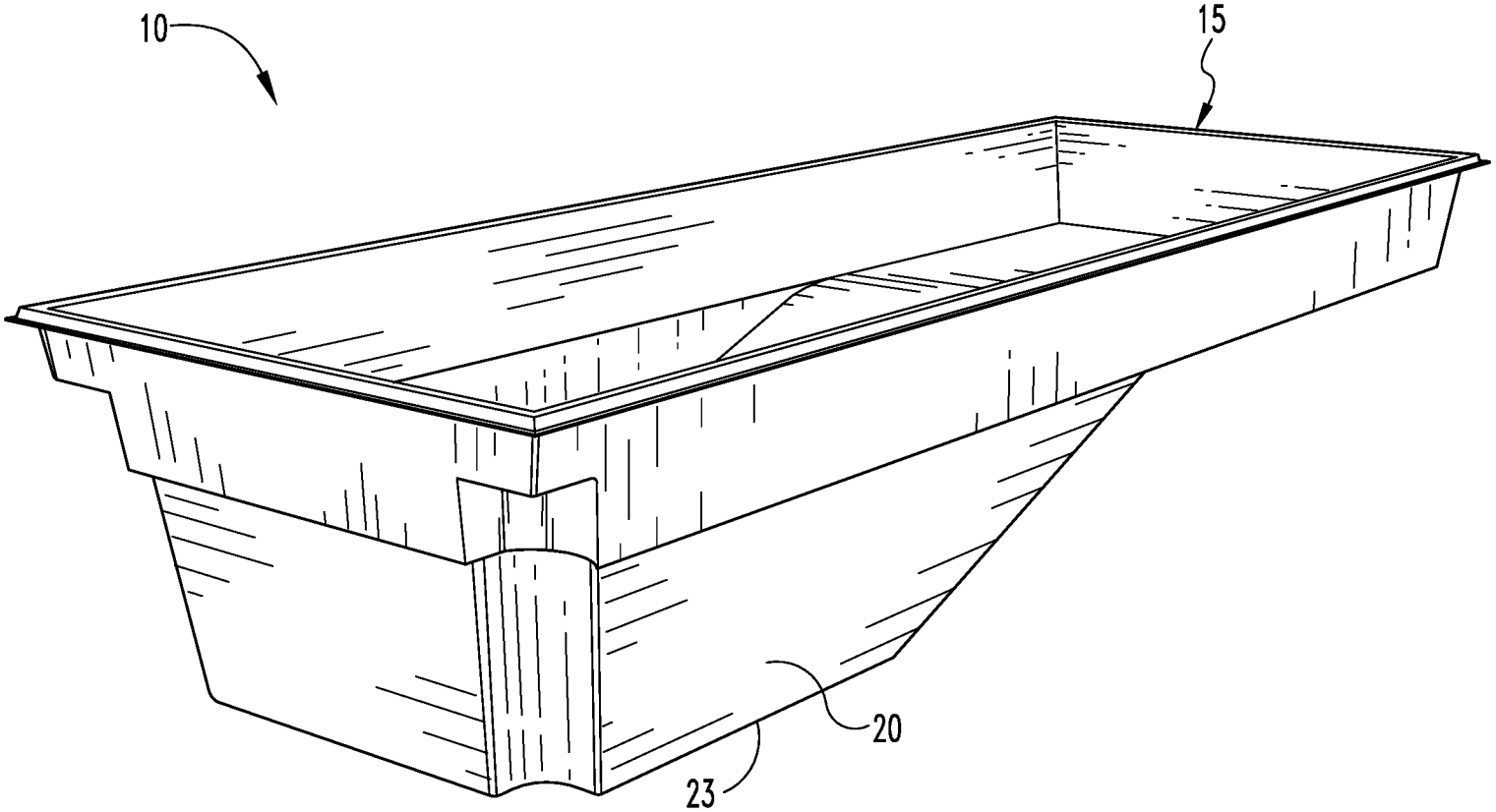
FIG. 1 is a top plan view of a first embodiment fiberglass pool assembly of the present novel technology.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

Figure 2:
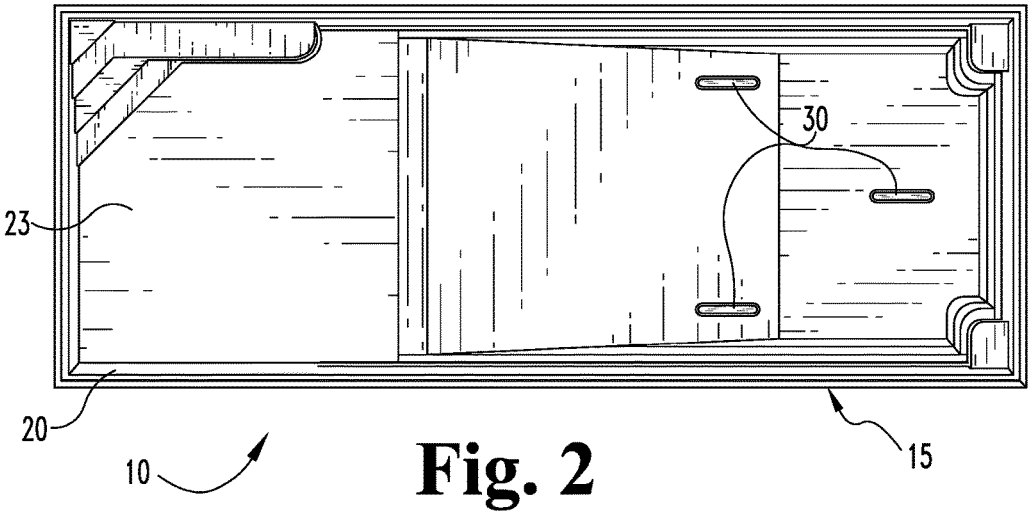
FIG. 2 is a top elevation view of the pool assembly of FIG. 1
Figure 3:
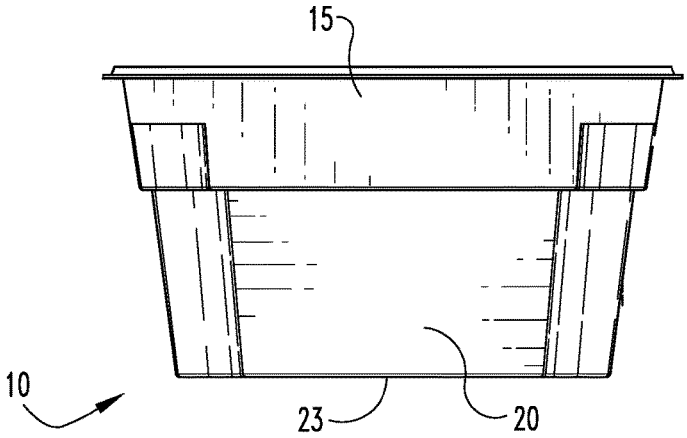
FIG. 3 is an end view of the curtain of FIG. 1.
Figure 4:
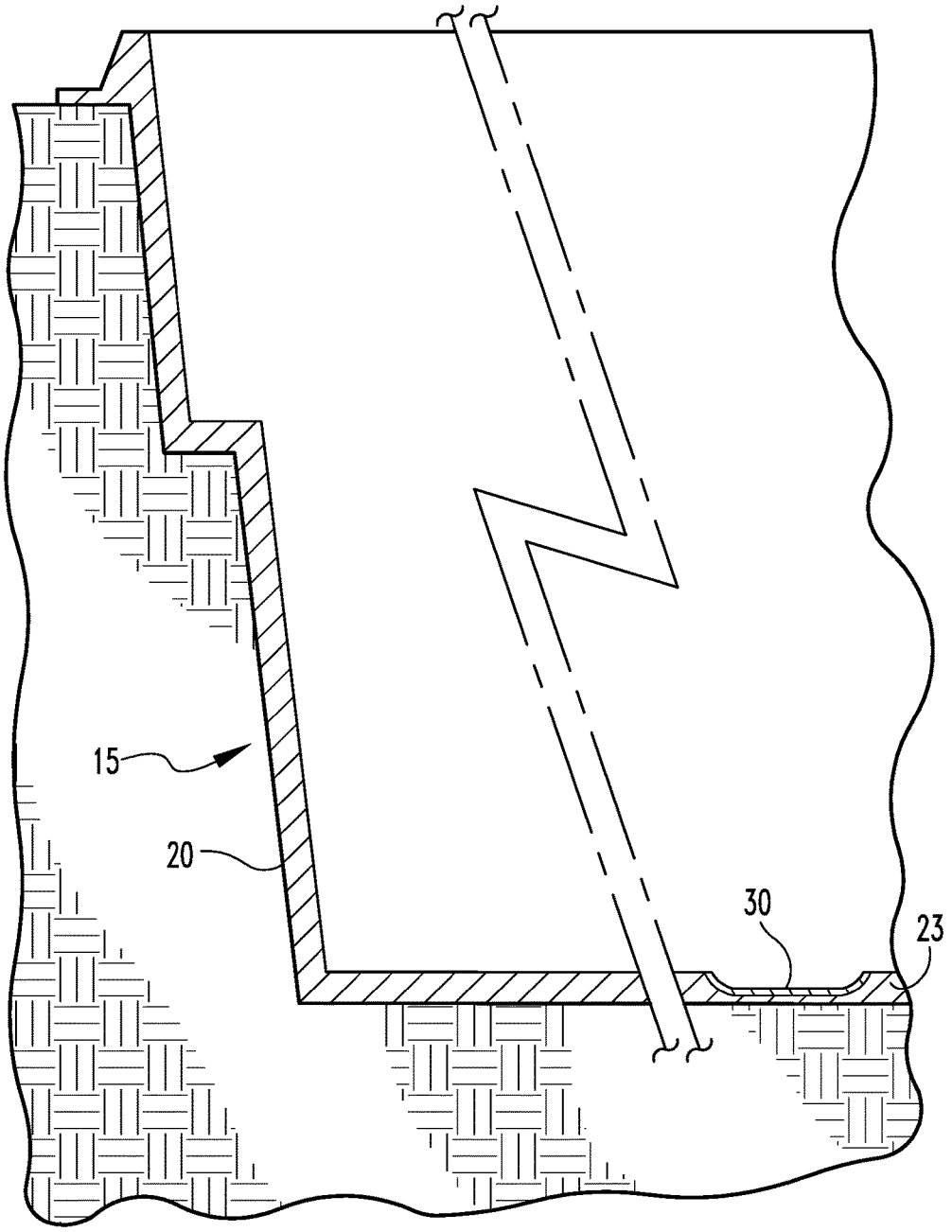
FIG. 4 is a partial cutaway view of the pool body of FIG. 1 having a ground heave protection device in the bottom floor.
Figure 5:
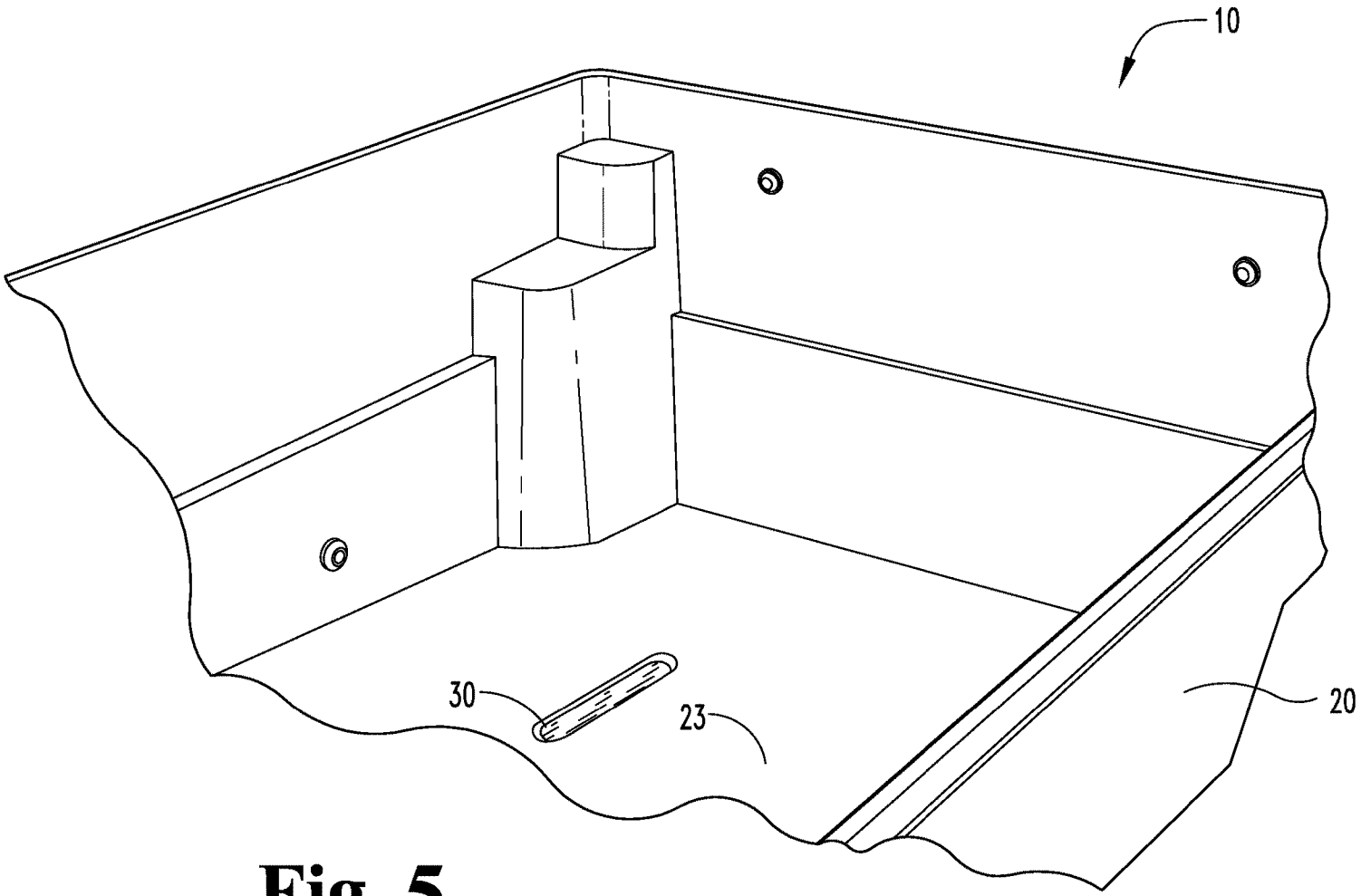
FIG. 5 is a partial perspective view of the pool body of FIG. 4.
Figure 6A:
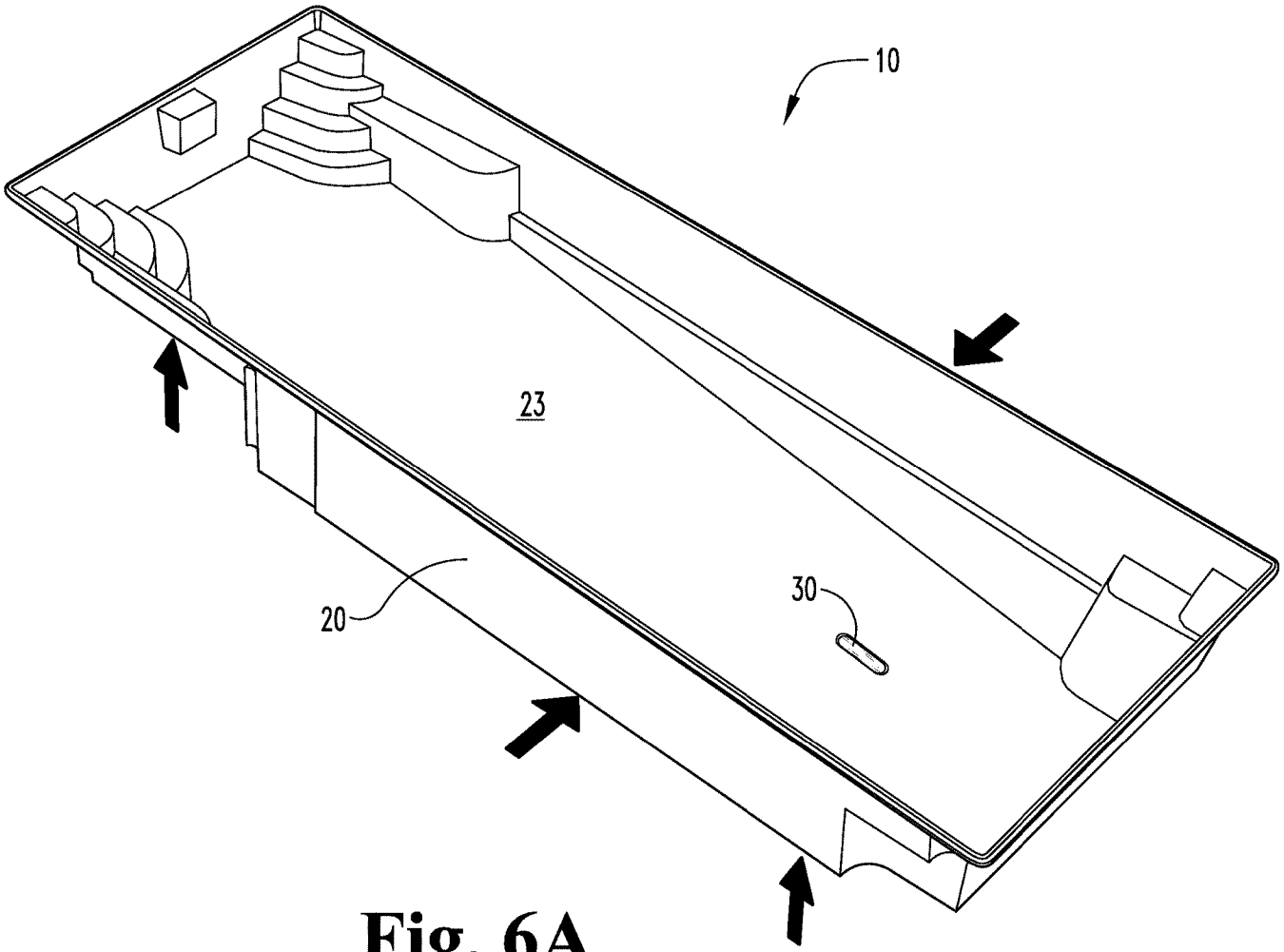
FIG. 6A is a first perspective view of the ground heave protection device system of FIG. 4 engaged with a pool body experiencing hydrostatic pressure from groundwater.
Figure 6B:
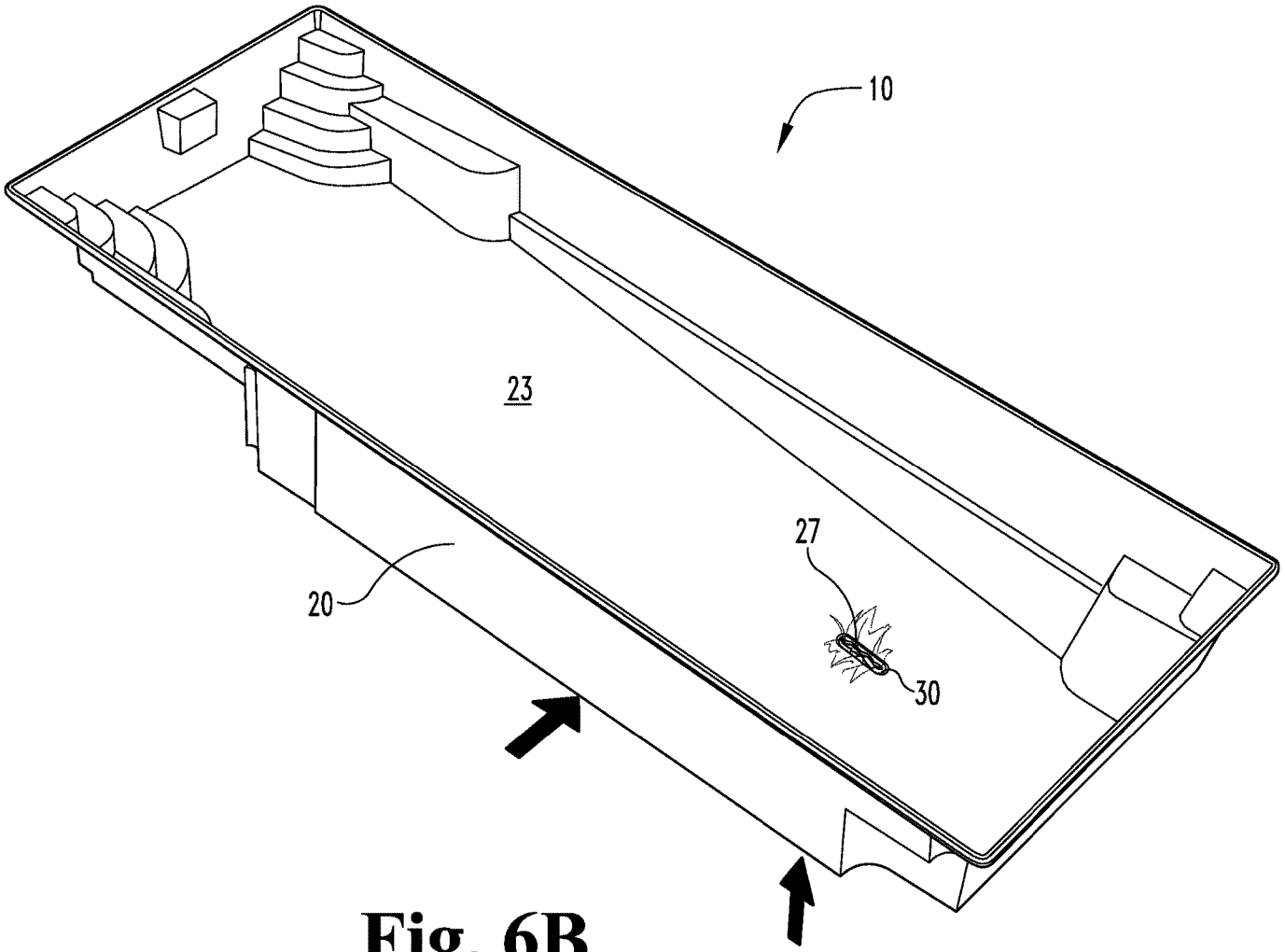
FIG. 6B is a second perspective view of the ground heave protection device system of FIG. 1 engaged with a pool body and rupturing under hydrostatic pressure.
Figure 6C:
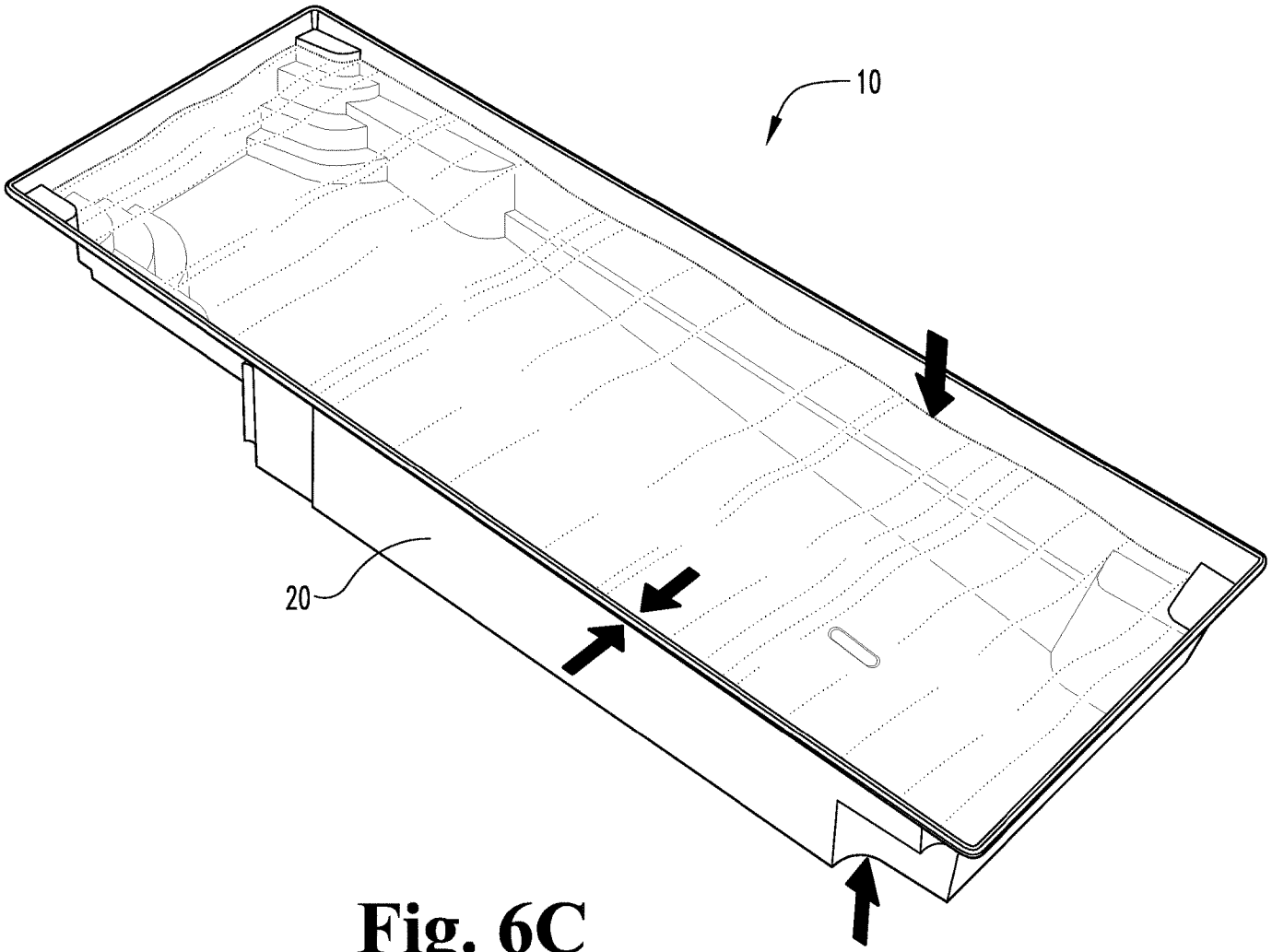
FIG. 6C is a third perspective view of the ground heave protection device system of FIG. 1 engaged with a pool body post rupture with the pool body filled with water in equilibrium with the externally applied hydrostatic pressure.

The present novel technology illustrated in FIGS. 1-6C relates to a system 10 for resisting hydrostatic and/or hydrodynamic forces generated by groundwater on a preformed swimming pool body 15 positioned in the ground, such as in a custom dug excavation, and includes a at least one, and more typically a plurality, of stress risers 30 operationally connected to the sidewall 20 or bottom wall or floor 23 of the swimming pool body 15.

Groundwater can cause catastrophic damage to any in-ground swimming pool if not controlled, and an empty in-ground pool body 15 is particularly susceptible to the upward forces imparted by groundwater under and around the pool body, such that the pool body 15 may be catastrophically dislodged from the ground. Dewatering systems, well points, hydrostatic valves and simple instructions to never drain the pool water sometimes fail due to mechanical failure, electrical failure, and/or human error. Damages done to fiberglass and concrete pools is typically structural, due to the effects of buoyancy. The groundwater may buckle or crack the floor 23 of the pool body 15, and other structural damage may occur which is typically extremely expensive to repair.

Additional damage common to excess hydrostatic pressure includes walls 20 bulged in on fiberglass pool bodies 15, damaged plumbing and electrical systems, and damaged concrete, pavers, and/or decking around pools when the pool "floats" or "pops" out of the ground.

The repair costs associated with floating a pool body 15 are prohibitive. To avoid potential catastrophic damage to fiberglass pools a groundwater heave protection device 30 has been developed. The device 30 may be implemented into the floor 23 of the fiberglass pool body 15 so as to provide a known and predetermined structural weakness in the pool bottom 23 that will fail before the groundwater pressure is sufficient to "pop" or "float" the pool body 15 out of the ground. The device 30 is typically an elongated strip and is more typically constructed of material having a physical strength, toughness, and/or modulus of rupture less than that of the floor material 23. In some cases, the device 30 is made of the same material as the floor 23, but is substantially thinner and/or at least partially perforated. In other embodiments, the device 30 is made of a different material more prone to failure under externally applied hydrostatic forces. Typically, the device 30 is elongated so as to provide a localized slit in the floor 23 upon failure as the predetermined and localized failure mode.

The device 30 may be molded and formed into the fiberglass pool floor 23 as a unitary piece, or may be inserted into the fiberglass floor 23 during the manufacturing process. Likewise, such a stress-riser device 30 may be incorporated into concrete pool bodies 15. The device 30 creates a stress concentration and/or stress riser and/or otherwise weakened area in the floor 23 of the fiberglass pool body 15, such that hydrostatic or buoyancy forces preferentially split the pool body 15 at the stress-riser device 30, allowing water to enter the pool body 15 to relieve the hydrostatic forces on the pool body 15, causing only localized and easily repairable damage to the pool body 15 in the process. In other words, the pressure from groundwater accumulation will crack open the insert or molded in stress riser 30 and allow groundwater to pour into the pool instead of causing catastrophic damage to the pool and/or its surroundings.

The pool body 15 includes a stress riser 30, typically an area of thinned and/or relatively weak material so the water pressure rips or separates the pool floor 23 at the thinned material 30 and opens to allow water to flow into the pool, relieving the pressure and adding mass to the pool contents. The location and size of the molded stress riser 30 is a function of the shape and size of the pool 15. When groundwater pressure breaks through, cracks, or otherwise ruptures the groundwater heave protection device 30 damages to pool floor 23 result in a very small and restricted aperture 27 occupying a predetermined location and resulting from a predetermined failure mode; said rupture 27 is relatively easily repaired. In other words, the groundwater heave protection device 30 has a significantly lower resistance to externally applied groundwater pressure than does the bottom floor member 23, and when the groundwater heave protection device 30 fails under applied external groundwater pressure, said failure yields an elongated aperture 27 in the bottom floor member 23 through which groundwater may flow into the fiberglass swimming pool body 15 to equalize the external hydrostatic forces with internal hydrostatic forces (see FIGS. 6A-6C).

In some embodiments, the protection device 30 is made of the same fiberglass material as the bottom member 23 but with thinner dimensions. For example, the protection device 30 may be an elongated strip of fiberglass having less than half the thickness of the surrounding floor 23. In other embodiments, the protection device 30 is a (typically elongated) patch of material having lower strength and/or resistance to rupture from externally applied hydrostatic pressure than the fiberglass pool body material, such as rubber, plastic, glass, foamed glass, polypropylene, foam, combinations thereof, or the like. In one embodiment, the device 30 defines a core foam or polypropylene layer positioned or sandwiched between two thin fiberglass layers, with the entire thickness of the device 30 still less than that of the fiberglass bottom portion 23. In yet other embodiments, the device 30 is typically partially perforated or otherwise geometrically weakened to focus and direct the rupture mode of failure.

The split 27 in the floor 23 may typically be repaired by grinding, glassing over the split and/or applying gel coat. This repair is done simply and is very inexpensive as compared to repairing and/or replacing a floated pool.

The pool body 15 may be of any convenient shape, including rectangular, generally rectangular, kidney shaped, round, oval, or the like. The protection device 30 may be positioned along or parallel the major axis of an elongated or rectangular pool 15, may be positioned perpendicular to the major axis, or may be otherwise oriented. Likewise, one or more groundwater heave protection devices 30 may be positioned at one or more predetermined positions, such as those believed to experience force maxima from groundwater or those portions of the pool body 15 believed to be most susceptible to damage from externally applied forces.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

We claim:

1. A method of stabilizing a preformed swimming pool body, comprising:

a) weakening a predetermined portion of a swimming pool body;

b) rupturing the weakened portion under pressure from groundwater to yield an aperture through the swimming pool body; and c) venting ground water into the swimming pool through the aperture to relieve external groundwater pressure on the swimming pool body.

2. The method of claim 1, and further comprising:

d) repairing the aperture.

* * * * *